United States Patent [19]

Koeneker

[11] 3,976,225

[45] Aug. 24, 1976

[54] FLOOD CONTROL FOR BEVERAGE VENDOR

[75] Inventor: William V. Koeneker, St. Louis, Mo.

[73] Assignee: UMC Industries, Inc., New York, N.Y.

[22] Filed: July 15, 1974

[21] Appl. No.: 488,479

[52] U.S. Cl. ..... 222/108

[51] Int. Cl.[2] ..... B67D 1/16

[58] Field of Search ..... 222/108, 2, 5, 52, 67, 222/129.3, 129.4; 194/13, 3; 137/312

[56] References Cited

UNITED STATES PATENTS

| | | | |
|---|---|---|---|
| 3,063,432 | 11/1962 | Bond et al. | 137/312 X |
| 3,193,072 | 7/1965 | Maxwell | 194/13 |
| 3,794,219 | 2/1974 | Pitel et al. | 222/108 |

FOREIGN PATENTS OR APPLICATIONS

| | | | |
|---|---|---|---|
| 1,133,586 | 7/1962 | Germany | 222/129.4 |

*Primary Examiner*—Stanley H. Tollberg
*Attorney, Agent, or Firm*—Koenig, Senniger, Powers and Leavitt

[57] ABSTRACT

A beverage vendor having a water system including a line for bringing water into the cabinet of the vendor, a valve in the line and a flood control comprising means for collecting water discharged from the system upon a failure thereof and means responsive to the collection of flood water in the collecting means before it overflows for closing the valve to cut off the supply of water.

4 Claims, 6 Drawing Figures

FLOOD CONTROL FOR BEVERAGE VENDOR

BACKGROUND OF THE INVENTION

This invention relates to a flood control for a beverage vendor, i.e., a control for preventing flooding in the event of a failure of the water system of the vendor.

The invention is especially concerned with either hot or cold drink vendors (coffee and carbonated drink vendors) which heretofore have had the problem of flooding upon a failure of the water system in the cabinet of the vendor. It will be understood that such beverage vendors have a system for bringing water into the cabinet to supply the water for making coffee (in the case of a hot drink vendor) or carbonated water (in the case of a cold drink vendor). Heretofore, a failure of the water supply system in the cabinet of the vendor (e.g., a leak in a pipe in the system) has resulted in water flooding the cabinet and pouring out of the cabinet over the surrounding area with attendant damage and claims against the vendor operator. The waste bucket and overflow control therefor heretofore used in beverage vendors to collect overflow or spillage from a cup at the dispensing station of the vendor do not take care of the problem of a failure in the water supply system.

SUMMARY OF THE INVENTION

Among the several objects of the invention may be noted the provision of a beverage vendor with a flood control for automatically cutting off the water supply in the event of a failure of the system within the cabinet, thereby to prevent flooding and water damage to the vendor and to the area surrounding the vendor; the provision of such a control which contains such water as may leak from the system within the cabinet; the provision of such a control which senses a predetermined level of flood water collected in the cabinet and automatically cuts off the water supply to the vendor; the provision of such a flood control which does not require extensive modification or redesign of the vendor; and the provision of such a flood control which is of relatively simple and economical construction and reliable in operation.

Basically, a beverage vendor of this invention comprises a cabinet and a water supply system including a line bringing water into the cabinet and a valve in the line, with the improvement of a flood control means in the cabinet comprising means for collecting water discharged from the system upon a failure thereof and means responsive to the collection of flood water in the collecting means before it overflows for closing the valve to cut off the supply of water.

Other objects and features will be in part apparent and in part pointed out hereinafter.

Brief Description of the Drawings

Corresponding reference characters indicate corresponding parts throughout the several views of the drawings.

DESCRIPTION OF THE PREFERRED EMBODIMENTS

Figure 1:
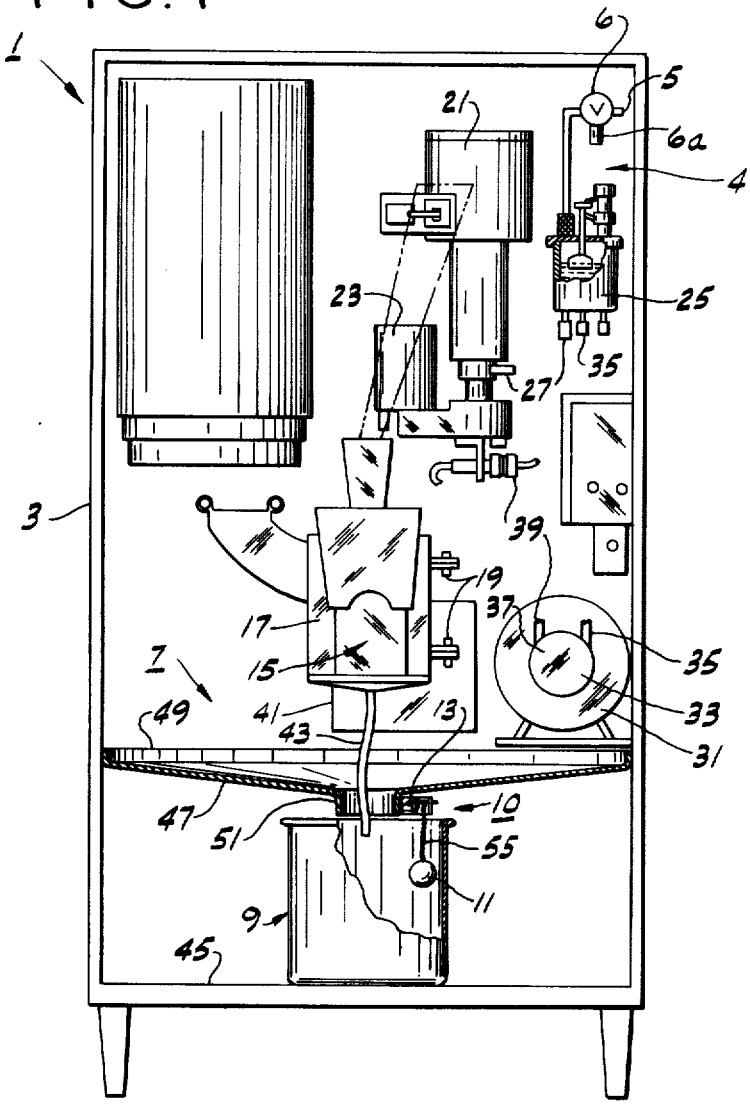
FIG. 1 is a front elevation of a beverage vendor shown partially in section with the front door of the cabinet open, illustrating a first embodiment of a flood control of this invention.
Figure 2:
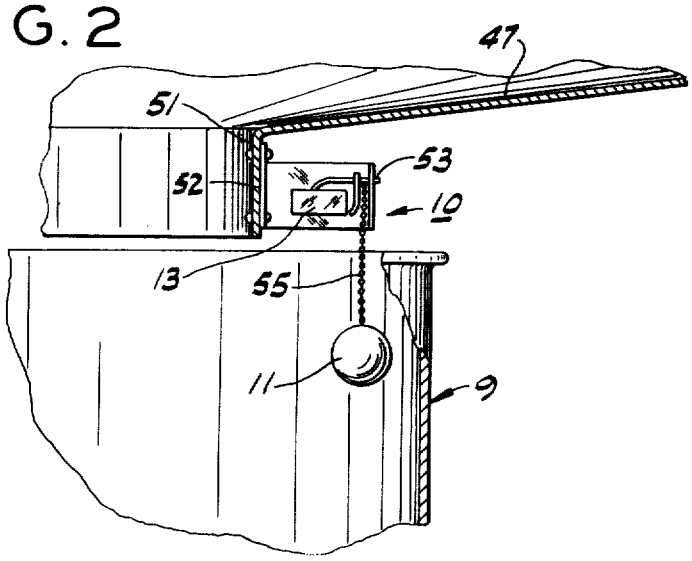
FIG. 2 is an enlarged fragmentary view of a portion of the vendor shown in FIG. 1 illustrating details of the flood control.
Figure 3:
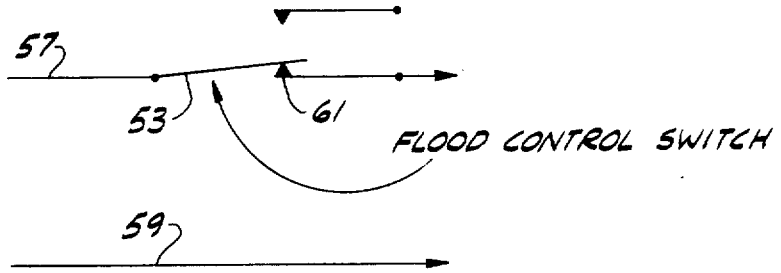
FIG. 3 is a schematic diagram showing part of an electrical circuit for the flood control.

Referring first to FIGS. 1–3 of the drawings, a beverage vendor, more particularly a cold drink vendor, is indicated in its entirety at 1, and comprises a cabinet 3 with a water supply system 4 therein. The latter includes a line 5 bringing water into the cabinet and a solenoid-operated control valve 6 for controlling the supply of water to the system. An electrical circuit for energizing the solenoid **6*a* of control valve 6 is depicted in FIG. 3. A flood control means 7 of this invention is also included in the cabinet, having means such as indicated at 9 for the collection of water flooding from the water system in the event of a break of failure anywhere in the system within the cabinet. As shown in FIGS. 1 and 2, means 9 comprises a waste bucket such as conventionally used in drink vendors to receive drainage from the delivery station of the vendor. Means 10, such as a flood control float 11 and a flood control switch 13, is provided responsive to the collection of water to a predetermined level in bucket 9 for actuating the solenoid 6*a* of control valve 6** thereby to cut off the supply of water to the water supply system.

More particularly, beverage vendor 1 (illustrated as a cold beverage vendor) includes a cup delivery station 15 on a panel 17 adapted to be swung out on hinges 19 when the front door of cabinet 3 is open. An ice maker 21 is located in the upper portion of the cabinet. An electric motor for the ice maker is indicated at 23. A water feed cup 25 adjacent the ice maker supplies water to the ice maker via a line 27. Water is supplied to cup 25 via line 5 and water supply control valve 6 so as to maintain a predetermined level of water in the cup. The water delivery system 4 includes a water pump 31 having its inlet side 33 supplied with water from cup 25 via a water line 35 and its outlet side 37 connected by line 39 to a carbonator 41. A drain line 43 is provided for draining off liquid from the delivery station 15 to the bucket 9.

As shown in FIGS. 1 and 2, the flood control means 7 includes a generally horizontal funnel-shaped wall or collection pan 47 in cabinet 3 spanning the cabinet and disposed below the level of the various components of the water delivery system 4 and above the bottom 45 of the cabinet so as to catch any water flooding or leaking from the water delivery system in the event of failure of any of its components. An upturned peripheral flange 49 integrally formed on wall 47 is secured to the side panels of cabinet 3. Pan 47 is funnel-shaped so as to direct flood water into the bucket 9, having a central opening 51 to which flood water is directed for flow down into the bucket 9. As best shown in FIG. 2, flood control switch 13 is mounted on a flange 52 of pan 47 below the pan adjacent the opening 51. Flood control float 11 is suspended from an actuating arm 53 of switch 13 by a chain 55 or other suitable means. Actuating arm 53 is spring biased upwardly, and the weight of float 11 suspended therefrom maintains switch 13 closed. When the flood water in bucket 9 reaches a predetermined level which causes float 11 to rise, chain 55 goes slack permitting actuating arm 53 to move upwardly. Switch 13 is thereby closed to deenergize solenoid 6*a* so as to close control valve 6 and to shut off the flow of water to water system 7.

In FIG. 3, the electrical circuit for operation of solenoid 6*a* is shown to comprise power lines 57 and 59 which provide power to vendor 1 and energize its various electrical components including flood control means 7. Actuating arm 53 of flood control switch 13 is shown connected in series in line 57 in its closed position making engagement with a respective contact 61 in supply line 57 thereby to supply power to the vendor and in particular to the solenoid 6*a* of control valve 6. Switch arm 53 is movable to its open or circuit breaking position disengaged from its respective contact 61 upon flotation of float 11 thereby to interrupt the power supplied to the vendor and to deenergize solenoid 6*a* and thus interrupt the supply of water to the vendor. It will be understood that this switch may also be utilized to energize a circuit indicating that the vendor is out of order.

With the component parts of vendor 1 positioned as shown in the drawing and as heretofore described, and with the level of the water or beverage spillage in bucket 9 below float 11, the weight of float 11 urges switch arm 53 of flood control switch 13 downwardly into circuit-making engagement with its respective contact 61 thereby to supply power to vendor 1 for energization of its various electrical components. With power supplied to solenoid 6*a* of control valve 6, the valve is open and water may circulate freely through the vendor water system 4. In the event of a failure of a component of the vendor water system, such as a rupture in one of the water lines, escaping flood water from the failed system component will pour downwardly into collection pan 47 which in turn directs it through central opening 51 for collection in bucket 9. When the collected flood water in bucket 9 rises to a predetermined level, float 11 floats upwardly causing the switch 13 to open and interrupt the power supplied to solenoid 6*a* so as to shut off the water supplied to the vendor. This prevents further flood water from escaping. By isolating the failed water system 4 from its water supply in the manner described hereabove, the volume of flood water which can escape from the failed system is limited to the amount of flood water which may readily be contained in the bucket 9, and this prevents water from running to the bottom of the cabinet and flowing out and causing damage to the area surrounding the vendor.

Figure 6:
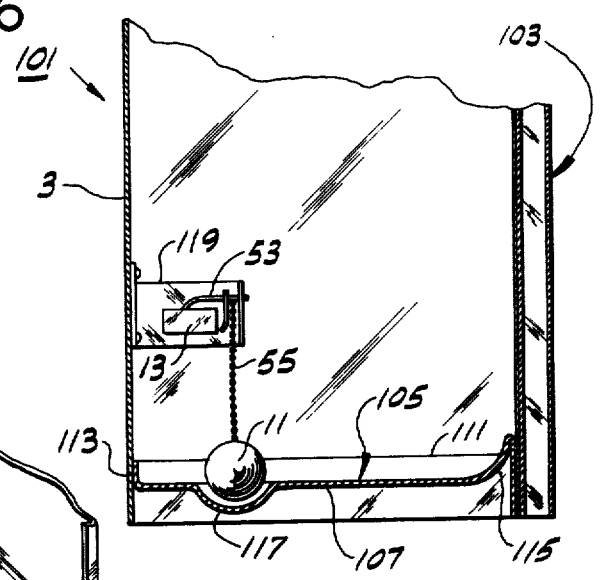
FIG. 6 is an enlarged vertical section taken on line 6—6 of FIG. 4.
Figure 5:
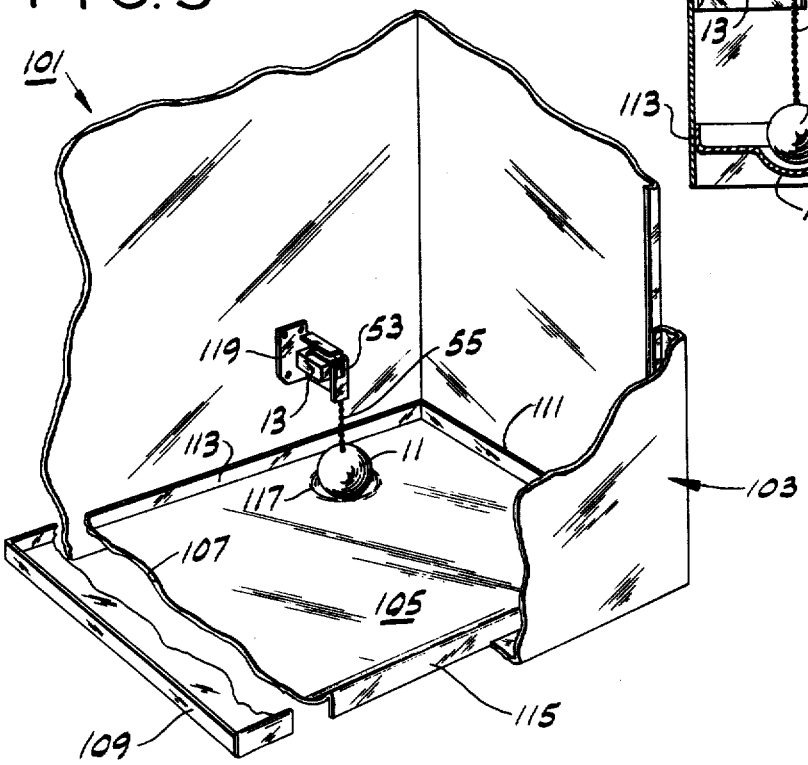
FIG. 5 is an enlarged perspective of part of FIG. 4 showing further details of the second-mentioned flood control.
Figure 4:
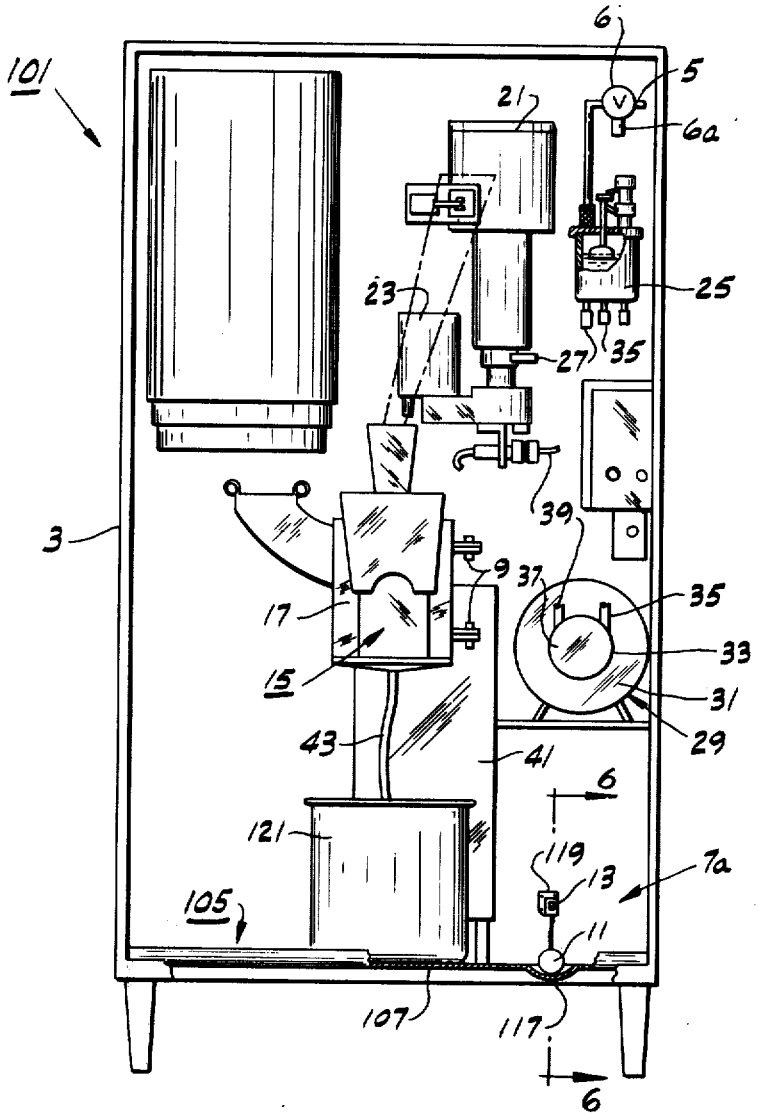
FIG. 4 is a front elevation of a beverage vendor having a second embodiment of the flood control of this invention.

Referring now to FIGS. 4–6, another beverage vendor 101 of this invention is illustrated having substantially the same components and parts therein and functioning in substantially the same manner as the previously described vendor 1. The door of the vendor is indicated at 103 (see FIGS. 5 and 6). Vendor 101 has a second embodiment, which may be preferred, of the flood control means of this invention, as indicated in its entirety at 7*a* so as to distinguish it from the previously described flood control system 7. Corresponding reference characters in vendors 1 and 101 indicate identical parts.

In vendor 101, the bottom panel of the cabinet 3 is constituted by a flood reservoir pan 105 having a base wall 107 and opposite side flanges 109, 111 and front and rear flanges 113 and 115. Reservoir pan 105 is positioned below the level of the components of water system 4 so that in the event of failure of the water system or any component thereof, water escaping from the failed system pours downwardly into the pan for collection and containment therein. A depression or recess 117 is formed in the base wall 107 at a convenient location, this depression or recess 117 constituting a sump. Flood control switch 13 is located generally above recess 117 and float 11 is suspended in the recess by means of chain 55 from switch actuating arm 53. Switch 13 is mounted on a mounting flange 119 secured to a back panel of cabinet 3 adjacent recess 117 so as to suspend float 11 therein. A bucket 121 is disposed on base wall 107 for receiving beverage spillage at delivery station 15 via line 43. If such beverage spillage overflows container 121, it will be understood that this overflow will be contained in reservoir pan 105. Thus, the pan 105 serves a dual role for collecting both flood water in the event of a leak and beverage spillage overflow from the bucket.

In operation of vendor 101, the weight of float 11 urges actuating arm 53 of switch 13 downwardly into circuit-making engagement with its contact 61 (see FIG. 3) thereby to effect energization of the vendor. As will be recalled, when power is supplied to solenoid 6a, it is energized to actuate water supply control valve 6 for supplying water to vendor water system 4. In the event of failure of the vendor water supply system, the escaping water pours downwardly and collects in recess 117 of the control pan 105, the recess being the lowest point in the pan. Upon collection of a predetermined level of water in recess 117, float 11 moves upwardly a predetermined distance and slack develops in chain 55 thereby to permit switch arm 53 of flood control switch 13 to move to its circuit breaking position thus deenergizing solenoid 6*a* and cutting off the supply of water to the vendor. When the power supplied to vendor 1 is so interrupted, the supply of water to the vendor water system 4 is cut off thus isolating it from the vendor water supply.

It will be understood that means other than a flood control switch 13 may be provided for effecting closure of valve 6 in the event flood water in the collection means reaches a predetermined level. For example, reservoir pan 105 in FIG. 4 may include two spaced electrical probes (not shown) so disposed relative to base 107 as to be contacted by water or beverage spillage collected in the pan 105 upon the flood water attaining a predetermined depth therein. Contact with the flood water completes an electrical circuit which deenergizes the solenoid 6*a* of control valve 6 and thus cutting off the supply of water to the vendor.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A beverage vendor of the type comprising a cabinet, a water supply system including a line for bringing water into the cabinet and a valve in said line with the improvement of a flood control means in the cabinet, said flood control means comprising means for collecting water discharged from said system upon a failure, and means responsive to collection of flood water in said collecting means before it overflows for closing the valve to cut off the supply of water, wherein said collecting means comprises a sump at the bottom of the cabinet, wherein the cabinet has a bottom panel formed to provide said sump, wherein said sump is a recess in said bottom panel and wherein said means responsive to collection of flood water comprises a float adapted to float in the water collected in said recess and a switch operable by the float, whereby upon flood water collecting in said bottom panel, it fills said recess thereby causing the float to rise above a predetermined level at which said switch is actuated to close said valve.

2. A beverage vendor as set forth in claim 1 further comprising means for interconnecting said float and said switch for actuation of said switch in response to movement of said float above said predetermined level.

3. A beverage vendor of the type comprising a cabinet, a water supply system including a line for bringing water into the cabinet and a valve in said line with the improvement of a flood control means in the cabinet, said flood control means comprising a pan for collecting water discharged from said system upon a failure, and means responsive to collection of flood water by said pan before the water overlows for closing the valve to cut off the supply of water, said pan being located below said water supply system and spanning the cabinet to collect water discharged upon a failure of any component of the water supply system within the cabinet, said pan being spaced above the bottom of the cabinet and having an opening therein for flow of water therethrough, a container positioned below said opening for receiving flood water collected by said pan, said means responsive to collection of water being responsive to collection of water in said container, said beverage vendor further having a cup delivery station and a drain from said station through said opening to said container, said means responsive to collection of flood water in said container also being responsive to collection of water draining into the container from said station.

4. A beverage vendor of the type comprising a cabinet having a bottom, a cup delivery station above the bottom, a water supply system including a line for bringing water into the cabinet to provide water for beverages, a valve in said line, a waste container in the cabinet for collecting waste from the cup delivery station via a drain from the cup delivery station, said bottom being formed to collect water discharged upon a failure of any component of the water supply system within the cabinet and overflow from the waste container, and means responsive to collection of water by the bottom of the cabinet for closing the valve to cut off the supply of water before it overflows from the bottom of the cabinet.

* * * * *